US005171086A

United States Patent [19]

Baloochi

[11] Patent Number: 5,171,086

[45] Date of Patent: Dec. 15, 1992

[54] HAND HELD ADJUSTABLE FOCUS FLASH LIGHT

[76] Inventor: Mohsen K. Baloochi, 5105 Montessa St., San Diego, Calif. 92101

[21] Appl. No.: 673,368

[22] Filed: Mar. 22, 1991

[51] Int. Cl.[5] ..... F21L 7/00; F21L 9/00

[52] U.S. Cl. ..... 362/188; 362/158; 362/183; 362/205; 362/207

[58] Field of Search ..... 362/188, 183, 207, 203, 362/285, 205, 158, 202, 319

[56] References Cited

U.S. PATENT DOCUMENTS

| | | | |
|---|---|---|---|
| 1,608,195 | 11/1926 | Barany | 362/188 |
| 1,823,763 | 9/1931 | Rathmann | 362/188 |
| 1,902,377 | 3/1933 | Rosenberg | 362/188 |
| 2,107,599 | 2/1938 | Chan | 362/188 |
| 2,516,993 | 8/1950 | Holt | 362/188 |
| 2,945,944 | 7/1960 | Gillespie | 362/188 |
| 3,196,268 | 7/1965 | Mack | 362/188 |
| 4,388,673 | 6/1983 | Maglica | 362/183 |
| 4,527,223 | 7/1985 | Maglica | 362/205 |
| 4,680,682 | 7/1987 | Parker | 362/158 |
| 4,843,526 | 6/1989 | Price, III | 362/207 |
| 4,916,588 | 4/1990 | Chu | 362/207 |
| 4,949,231 | 8/1990 | Wang | 362/183 |
| 4,987,523 | 1/1991 | Lindabury et al. | 362/188 |

FOREIGN PATENT DOCUMENTS

| | | | |
|---|---|---|---|
| 627077 | 10/1933 | Fed. Rep. of Germany | 362/188 |

*Primary Examiner*—Ira S. Lazarus
*Assistant Examiner*—Y. Quach
*Attorney, Agent, or Firm*—Frank D. Gilliam

[57] ABSTRACT

In a first embodiment, a combination "ON", "OFF" and "DIRECTIONAL SWITCH" operates to turn the light the light on and off and operate a electric motor to drive the lamp longitudinally to facilitate a change of light beam focal length. In a second embodiment, a combination "ON", "OFF" and "DIRECTIONAL SWITCH" operates to turn the light on and off and to manually translate the light bulb longitudinally to facilitate a change of light beam focal length. In both of the embodiments the beam focal length is adjustable through an infinite number of positions between maximum and minimum translation limits and the flashlight maintains the selected light beam focal length until a different light beam focal length is selected. In each embodiment a replacement bulb is contained within the body of the flashlight and is external removable therefrom.

4 Claims, 3 Drawing Sheets

HAND HELD ADJUSTABLE FOCUS FLASH LIGHT

BACKGROUND OF THE INVENTION

The present invention relates primarily to flashlights, and in particular to a flashlight which can conveniently be held, turned "OFF" and "OFF" and the focal length of the light beam selectively changed by one hand operation.

Various flashlight designs have addressed improvements to the optical characteristics of the flashlight. For example, certain designs incorporate variable light beam focal lengths. Some of these prior art devices are taught by U.S. Pat. Nos. 4,577,263; 4,658,336; 4,841,417; and 4,899,265.

In general these prior art devices facilitate beam focal length change by relative rotation of various portions of the flashlight housing.

One of the disadvantages of certain flashlights regardless of size is that these designs, although successful in enabling the light beam to be turned "ON" and "OFF" and the light beam focal length to be changed, is that these designs are such as to make the switching "ON" and "OFF" and the focusing of the light beam awkward, if not impossible to accomplish with the hand that is holding the flashlight by its barrel, or, handle. Because there exists a wide variety of uses for hand-held flashlights wherein the use would be facilitated by having a design such that the flashlight could be held in one hand, the light beam switched "ON" and "OFF" and focused with ease by the same one hand, it may be seen as a deficiency in this art that heretofore no flashlight combining features that provide such ease of operation has been previously developed. It is therefore desirable to provide a flashlight held in one hand and for which switching and focusing operations may be performed with the hand holding the flashlight with ease without requiring the holding hand to change its grip on the flashlight while switching and focusing. It is also desirable in certain circumstances to provide a flashlight having "one hand" operation where a particular focal length is maintained until further adjustment and switching and adjusting of the light beam focal length can be performed remote from the location of the flashlight.

The instant invention advances the hand held flashlight art in the areas of these certain deficiencies in the prior art flashlights.

SUMMARY OF THE INVENTION

In both embodiments of the invention, a two body or housing section flashlight has an internal battery power supply which is rechargeable either by an auto electrical system or a convenience outlet.

In a first embodiment the flashlight includes a combination power "ON"/"OFF" and "FOCUS" control switch for operating the light beam and adjusting the focus of that light beam. The switch includes a central push button light "ON"/"OFF" switch and a rocker switch which when pushed in a first direction causes the light beam to converge and in a second direction to cause the light beam to diverge, i.e. change the focal length of the light beam. The convergence and divergence of the light beam is caused by an electric motor which through a gear mechanism causes a slide carrying the light source, bulb, to translate relative to the light beam collimating reflector of the flashlight, i.e. when the switch is rotated in a first direction the motor rotation is directionally operated to move the lamp rearwardly relative to the distal or maximum divergent end of the reflector and when the switch is rotated in a second direction the motor rotation is directionally operated in the opposite rotational direction moving the lamp toward the distal or maximum divergent end of the reflector. The slide is carried by a channel secured to the inner surface of the housing.

In a second embodiment, the translation of the light to change light focal length is accomplished mechanically by a yoke operated by a similar rotatable combination switch. The yoke has an elongated slot that captures a pair of opposed pins on a light slide element which carries the light source, bulb, and causes the light slide to translate in a direction depending on the direction of rotation of the combination switch. If the combination switch is rotated in a first direction the light slide translates forward toward the distal or divergent end of the reflector and when the switch is rotated in the opposite direction the light slide is translated in the opposite direction away from the distal or divergent of the reflector. The light slide is carried by a channel attached to the flashlight housing and includes a biasing means so that the slide is resistive to movement whereby the light slide stays in its last selected translated position until the switch is again rotated. A spring washer (Beleville washer) may be positioned around each pin carried by the slide for abutment of the sides of the yoke to bias and maintain the light slide in the selected translated location until further rotation of the switch to establish a new light slide translated position or a spring or corrugated collar is positioned between the slide and the channel for the same purpose.

In the first embodiment the combination switch may be selectively removable and an extension control cord by be used to extend the combination switch to a location remote form the flashlight for turning the light "ON", "OFF" and changing the focus of the light beam.

In both embodiments, a spare lamp is stored within the flashlight housing and is removable externally of the housing.

A recharger may be used with either embodiment when the flashlight is powered by rechargeable batteries. The charger may be operated from either an DC or AC source to produce the required charging voltage in a known and conventional manner. A keyway is provide to properly align the flashlight with the charger anodes for engagement therewith.

An object of the invention is to provide a hand held flashlight which can be operated "ON" and "OFF" as well as the light beam focal length changed through an infinite number of different lengths between maximum and minimum lengths by one hand operation without moving the hand from its flashlight held hand.

Another object of the invention is to provide a hand held flashlight with the focus adjustment electrically positioned.

Another object of the invention is to provide a hand held flashlight with the "ON", "OFF" and focus functions mechanically operated from one hand while supporting the flashlight.

Still another object of this invention is to provide a hand held flashlight which the focal length can be changed remotely from the flashlight.

Yet another object of this invention is to provide a flash light with a spare light bulb stored within the flashlight housing.

Other objects and features of the invention will become apparent as the drawings which follow are understood by reading the corresponding description thereof.

BRIEF DESCRIPTION OF THE DRAWING FIGURES

DETAILED DESCRIPTION OF THE FIRST EMBODIMENT

Figure 2:
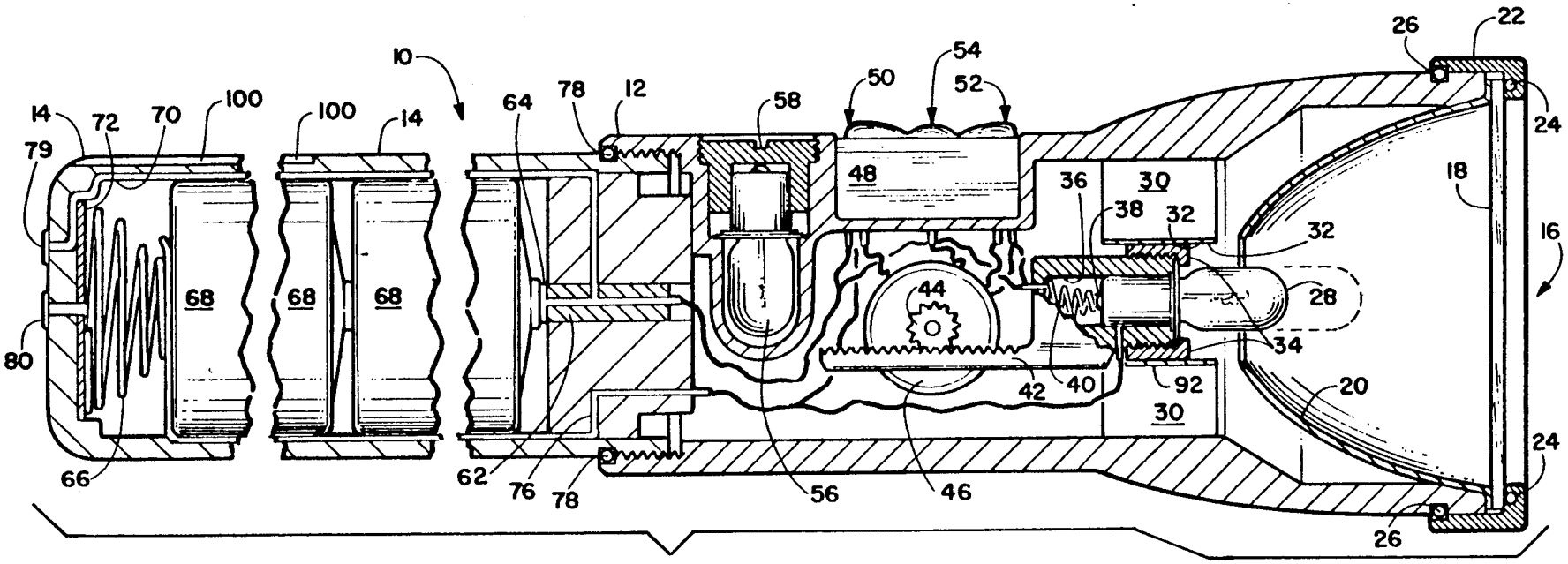
FIG. 2 is a cutaway showing of FIG. 1 taken along line 2—2 of FIG. 1.
Figure 1:
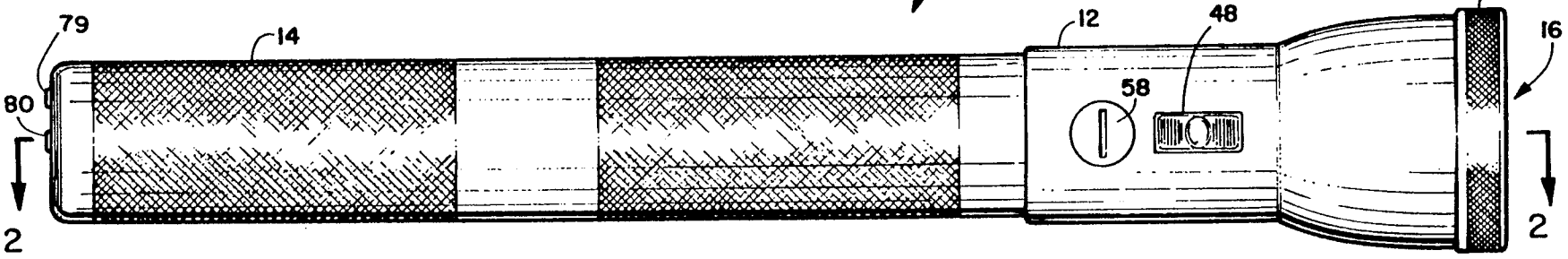
FIG. 1 is a top plan view of the flashlight of the invention.
Figure 3:
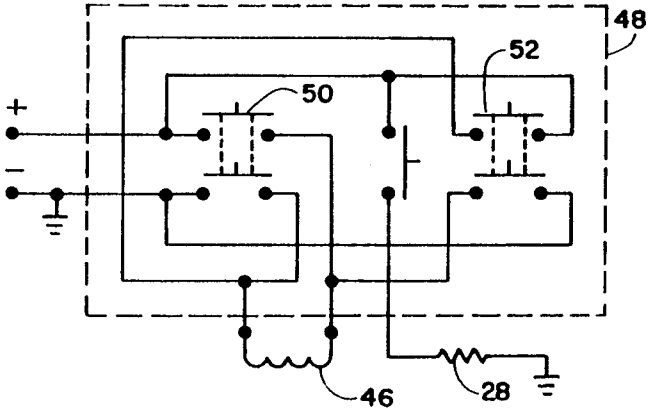
FIG. 3 is a showing of an extension control cord for remote "ON" and "OFF" and focal length control of the flashlight of the first embodiment of the invention.

The first embodiment of the invention is an electrically focal length operated hand held flashlight 10 as depicted in drawing FIGS. 1–3.

In drawing FIG. 1, the flashlight 10 is shown to be constructed of a two part housing 12 and 14. It should be understood that additional housing parts, not shown, could be positioned in series between the two parts shown to practice this invention if additional batteries for greater light intensity were required. The housing parts can be constructed of any material suitable for the purpose intended. The housing 12 has an open distal end 16 which includes a conventional lens 18 and a collimating light reflector 20 held in place by a cover 22. The cover 22 is sealed in a water tight relationship with the housing 12 by means of a pair of "O" rings 24 and 26. The source of light or bulb 28 is carried by a slide 30 which is supported and guided by a channel 32 carried by the inner surface of the housing part 12. A cover 34 positions the bulb within the opening 36 of the slide 30 with the electrical connection 38 hard against the distal end of the spring 40 which is attached to the positive battery terminals. The case of the bulb contacts the inner wall of the opening 36 where if the slide is constructed of metal which is the opposite or negative terminal of the batteries. If the slide is constructed of other than metal, a metal liner or contact is provided to make electrical contact with the bulb outer body surface.

The end of the slide opposite to the bulb carrying end is shown with a gear rack 42 the teeth of which engages the teeth of a rotating gear 44 carried by a DC motor 46. Obviously, when the motor is energized the gear 44 causes the slide to be translated in the direction of motor rotation and change the focal length of the light beam. The motor when in a non-operating condition prevents the slide from translating from the stopped position.

Combination switch 48 operates the motor rotational direction and turns the flashlight bulb "ON" and "OFF" by finger manipulation. When the switch is pressed toward arrow 50 the motor rotates in one direction and when pressed along arrow 52 the motor rotates in a second or opposite direction. When the center of the switch is pressed downward along arrow 54 the bulb is illuminated or extinguished depending on the current state of the bulb which is changed by the pressing of the switch.

A wiring diagram of a typical operating circuit is shown in drawing FIG. 3. Referring now to drawing FIG. 3, the positive and negative voltage from the batteries is connected to the various terminals as shown to operated the motor and illuminate the bulb as discussed above. A solid state circuit may be employed.

Referring again to drawing FIG. 2, a spare light bulb 56 is carried in a water tight compartment which is threaded into the housing 12. The spare bulb can easily be removed by inserting a coin or the like into the slot 58 and turning the coin or the like to unscrew the compartment from the housing. A new bulb or the water tight compartment minus the bulb may be replaced in a reverse fashion.

A positive contact 64 extends through the back wall 62 of the housing 12 and engages a positive battery terminal 64 carried by housing 14. The positive contact and the positive terminal are forced together by the spring 66 positioned between the rear wall of housing 14 and the negative or bottom of the pack of batteries 68. A metallic conductor 70 extends from the positive terminal of the batteries to the rear of the flashlight. An insulator 72 is positioned between the spring 66 and the conductor 70. A terminal 79 extends through the rear wall of housing 14 as an extension of the conductor 70 and a terminal 80 extends through the rear wall as an extension of the spring 66 and the negative conductor 76 which extends to the forward portion of the flashlight for light and motor operation. The terminals 79 and 80 are used to recharge rechargeable batteries if rechargeable batteries are used in the flashlight as herein after discussed in greater detail. The two or more portions of the flashlight are water proof sealed by threaded engagement and "O" rings 79 at the connection areas.

Figure 4:
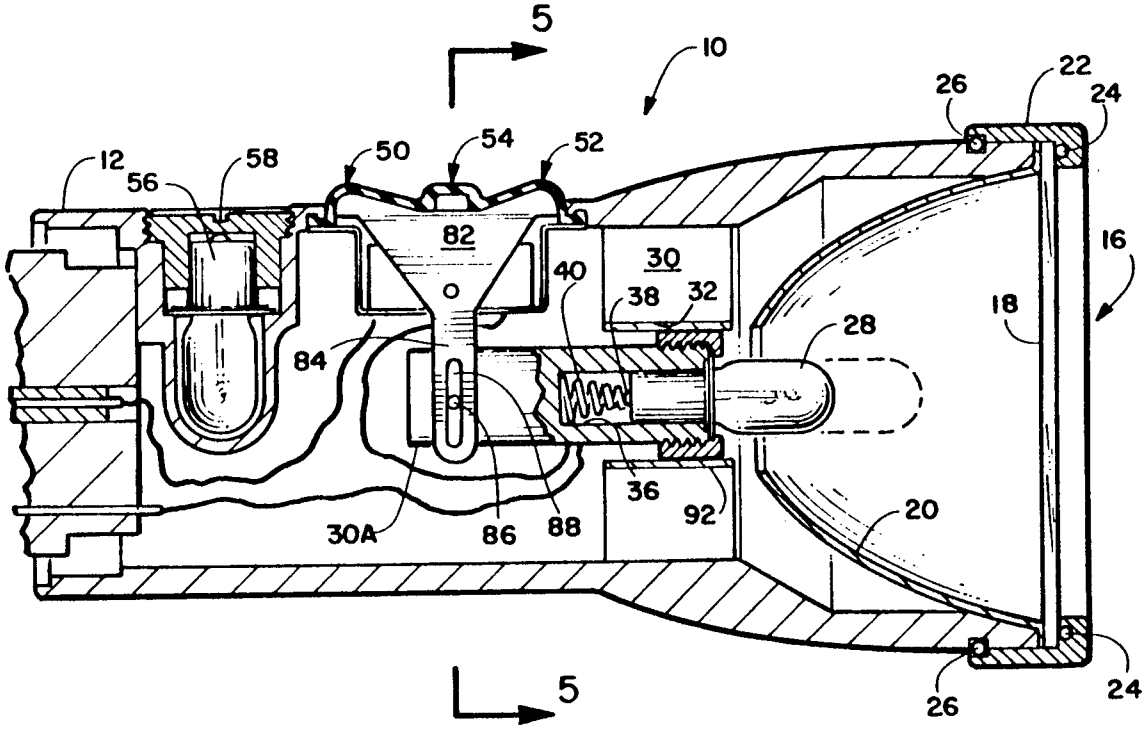
FIG. 4 is a partial cutaway showing of a second embodiment of the invention using a mechanical focal length changing switch.
Figure 5:
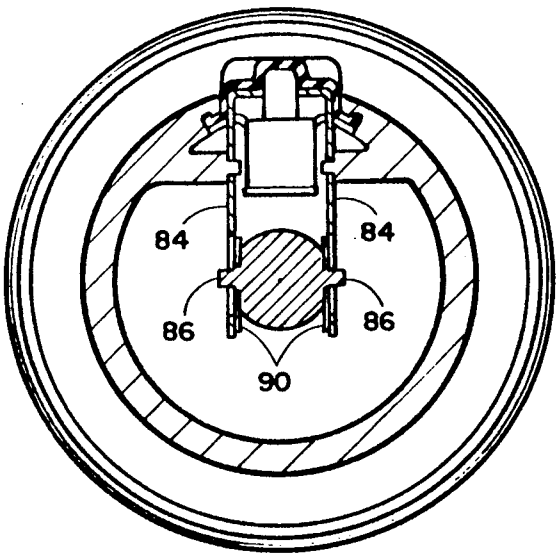
FIG. 5 is a cutaway showing taken along line 5—5 of FIG. 4.

Referring now specifically to drawing FIGS. 4 and 5, this embodiment is the same as the showing of the embodiment of drawing FIG. 2 except the translation of the lamp slide is manually translated rater than electrically translated. In this embodiment the combination switch 82 rotates in the same manner as combination switch 48 described above and turns the light bulb "ON" and "OFF" in the same manner. The switch, however, includes a yoke 84 which extends on each side of the light bulb slide 30A and is attached through pins 86 which are trapped in an elongated slot 88 in the yoke. To bias the slide from unwanted movement with a spring washer 90 of the Bellevue type or a corrugated spring sleeve 92, see drawing FIG. 2. In operation the switch 82 is rotated in either direction 50 or 52 and the yoke translates the slide in the direction of rotation and the pins 86 translate either up or down in slot 88. The slide moves the lamp in or out of the reflector to change the focal length of the beam in the same manner as hereinbefore discussed.

Figure 6:
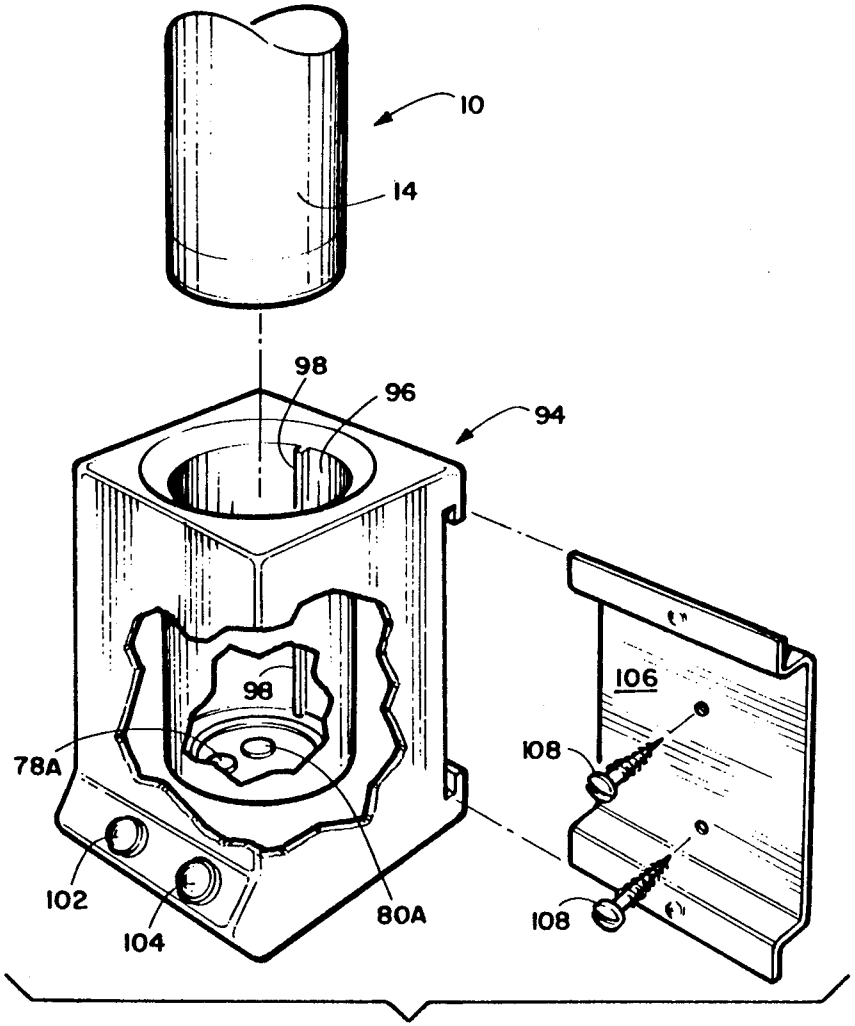
FIG. 6 depicts in partial cutaway a charging stand for both embodiment of the invention.

Referring now specifically to drawing FIG. 6 which depicts a battery charger 94 for rechargeable batteries that may be used in the flashlight 10. The charger has a receiving cylindrical chamber 96 for insertion of the rear end portion of the flashlight for recharging. A rib 98 extends along the wall of the chamber 96 and engages an elongated slot 100 on the housing 14 of the flashlight, see drawing FIG. 1, to insure that terminals 79 and 80 register with terminals 78A and 80 A of the charger 94. A pair of lights 102 and 104 on the base of the charger indicated respectfully a charging condition and power to the charger. A bracket 106 which can be attached to a fixed surface, not shown, for removably securing the charger in a fixed position. Screws 108 are used to attach the bracket 106 to the fixed surface. The charger is powered either by an AC voltage source which is reduced to a suitable level and rectified or to a suitable DC supply such as, for example, an automobile voltage system.

Figure 7:
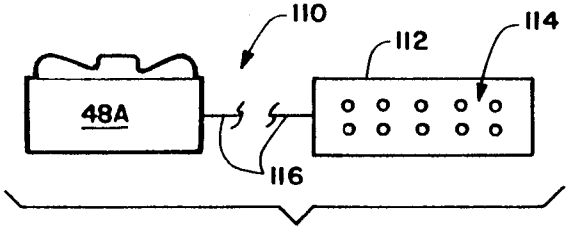

Referring now to drawing FIG. 7, if a remote control of the focal length or operation of the light is desired, the switch 48 of the first embodiment of the flashlight can be made removable wherein an extension 110 can be inserted into the void left in the flashlight housing by the removal of switch. The extension includes a plug 112 for insertion into the void which engages the terminals 114 which normally register with the bottom of the switch 48, ie. the power inputs and the outputs to the lamp and motor. A switch 48A which is a switch equivalent to switch 48 is connected in the same manner as switch 48 through cable 116 to the terminals 114 so that operation of remote switch 48A is identical to the operation of switch 48 described above.

The various components of the flashlight are chosen to be suitable for the purposes intended.

While specific embodiments of the flashlight has been shown and fully explained above for the purpose of illustration it should be understood that many alterations, modifications and substitutions may be made to the instant invention disclosure without departing from the spirit and scope of the invention as defined by the appended claims.

What is claimed is:

1. A hand held flashlight with one hand operation for changing the "ON"/"OFF" state of a lamp and the translation of that lamp to change the focal length of the light form that lamp comprising:

a lamp mounted on a lamp slide;

a source of electrical power; and a combination switch and lever means, said switch selectively electrically connecting and disconnecting said source of electrical power to said lamp, and the lever means connected to said lamp slide, said switch means manipulatable linearly by the fingers of the hand holding the flashlight for turning said lamp "ON" and "OFF" and for the rotational movement of said lever means for translating only said lamp slide and said lamp linearly in either direction and thereby changing the focal length of the lamp without repositioning the hand from its flashlight support position.

2. The hand held flashlight of claim 1 wherein said flashlight is formed of at least two interconnectable housing section, a first one of said at least two interconnectable housing sections having an integral closed end surface, said flashlight being water tight at a joinder of said at least two interconnectable housing section.

3. The hand held flashlight of claim 2 wherein a second one of said at least two interconnectable housing sections includes an aperture with an external access for receiving in a water tight manner a spare lamp for said flashlight.

4. The flashlight as defined in claim 1 further comprising bias means to hold the position of said lamp slide until said switch means is further manipulated to refocus the light beam.

* * * * *